US007553153B2

(12) United States Patent
Okazaki et al.

(10) Patent No.: US 7,553,153 B2
(45) Date of Patent: Jun. 30, 2009

(54) BURNER AND COMBUSTION METHOD FOR SOLID FUELS

(75) Inventors: Hirofumi Okazaki, Hiroshima (JP); Kenji Yamamoto, Hitachinaka (JP); Masayuki Taniguchi, Hitachinaka (JP); Kouji Kuramashi, Kure (JP); Kenji Kiyama, Kure (JP); Takanori Yano, Kumano (JP)

(73) Assignee: Babcock - Hitachi K.K., Tokyo (JP)

( * ) Notice: Subject to any disclaimer, the term of this patent is extended or adjusted under 35 U.S.C. 154(b) by 94 days.

(21) Appl. No.: 11/529,622

(22) Filed: Sep. 29, 2006

(65) Prior Publication Data

US 2007/0026356 A1 Feb. 1, 2007

(51) Int. Cl.
*F23C 7/00* (2006.01)
*F23Q 9/00* (2006.01)

(52) U.S. Cl. ..... 431/187; 431/185; 431/277

(58) Field of Classification Search ..... 431/277, 431/185, 187; 110/261, 262, 264, 265
See application file for complete search history.

(56) References Cited

U.S. PATENT DOCUMENTS 4,807,541 A * 2/1989 Masai et al. ..... 110/262
5,199,355 A * 4/1993 Larue ..... 110/261
5,231,937 A * 8/1993 Kobayashi et al. ..... 110/262
5,263,426 A * 11/1993 Morita et al. ..... 110/265
5,799,594 A * 9/1998 Dernjatin et al. ..... 110/265
5,806,443 A * 9/1998 Kobayashi et al. ..... 110/262
6,112,676 A * 9/2000 Okazaki et al. ..... 110/261
6,189,464 B1 * 2/2001 Okazaki et al. ..... 110/347
6,298,796 B1 * 10/2001 Okazaki et al. ..... 110/345
6,889,619 B2 * 5/2005 Okazaki et al. ..... 110/347

FOREIGN PATENT DOCUMENTS

JP 5-231617 A 9/1993
JP 11-44411 A 2/1999
JP 2000-504406 A 4/2000
JP 2000-130710 5/2000
JP 2000-356309 A 12/2000
WO 98/21524 A2 5/1998

OTHER PUBLICATIONS

Japanese Office Action mailed Feb. 2, 2009.

* cited by examiner

*Primary Examiner*—Kenneth B Rinehart
*Assistant Examiner*—Jorge Pereiro
(74) *Attorney, Agent, or Firm*—Crowell & Moring LLP

(57) ABSTRACT

A solid-fuel burner comprising a fuel nozzle for injecting a mixed fluid with a mixture of solid fuel and air as a carrier gas thereof, a plurality of air nozzles provided on the outside of the fuel nozzle for surrounding the fuel nozzle; an end portion of an inner circumferential wall of the air nozzle located at least at the outermost circumference is outwardly expanded, and an inductive member provided at outlet of the air nozzle located at least on the outermost circumference so as to direct flow of air in the direction of outer circumference.

2 Claims, 6 Drawing Sheets

BURNER AND COMBUSTION METHOD FOR SOLID FUELS

BACKGROUND OF THE INVENTION

1. Field of the Invention

The present invention relates to a solid-fuel burner for burning solid fuels and a combustion method by using the burner. The burner according to the present invention is specifically suitable for the use as a single-stage combustion burner which can be relied on alone for the complete combustion of solid fuels.

2. Prior Art

Solid-fuel burners designed for burning solid fuels such as coal particle are required to reduce the concentration of nitrogen oxide (hereinafter, called as Nox). To meet this requirement, low-NOx burners that create a decrease-NOx reaction in the flame have been developed. In these low-NOx burners, by introducing fuels into the flame, which lacks oxygen and its temperature is high, nitrogen contents contained in the fuel are changed into deoxidization materials, such as ammonia or cyanogen, and discharged, thereby reducing NOx to nitrogen. In a low-NOx burner, it is necessary to create a deoxidization flame, which lacks oxygen and its temperature is high, near the burner. For this reason, various proposals have been made so as not to mix fuel with air near the burner. For example, a technology has been proposed wherein the end portion of the partition wall that separates the outermost circumferential air nozzle from the inner air nozzle is designed to be a pipe expanding structure so that air flowing through the outermost circumferential air nozzle can be injected in the direction of the outer circumference (for example, see patent document 1).

[Patent document 1] Japanese Patent Publication No. 3344694 (claim 1, FIG. 1)

SUMMARY OF THE INVENTION

When an inductive member is provided at the end portion of the partition wall that separates the outermost circumferential air nozzle from the inner air nozzle in order to change the direction of air, which flows through the outermost circumferential air nozzle, from the direction parallel to the burner's axial direction to the direction of the outer circumference. Here, there is a problem in that heat radiated from the flame causes the temperature of the inductive member to become high, thereby resulting in the occurrence of thermal damage.

The object of the present invention is to provide a solid-fuel burner which includes an inductive member in an outermost circumferential air nozzle so that air can be injected in the direction of the outer circumference, thereby preventing damage to the inductive member caused by heat.

The present invention provides a solid-fuel burner comprising a fuel nozzle for injecting a mixed fluid that is a mixture of solid fuel and air, which is a carrier gas thereof, and at least one air nozzle provided on the outside of the fuel nozzle so that the air nozzle surrounds the fuel nozzle, wherein the end portion of the inner circumferential wall of the air nozzle located at least at the outermost circumference is outwardly expanded; the solid-fuel burner further comprising an inductive member provided between the inner circumferential wall and the outer circumferential wall of the air outlet of the air nozzle located at least on the outermost circumference so as to direct the flow of air in the direction of the outer circumference.

DETAILED DESCRIPTION OF THE INVENTION

Figure 1:
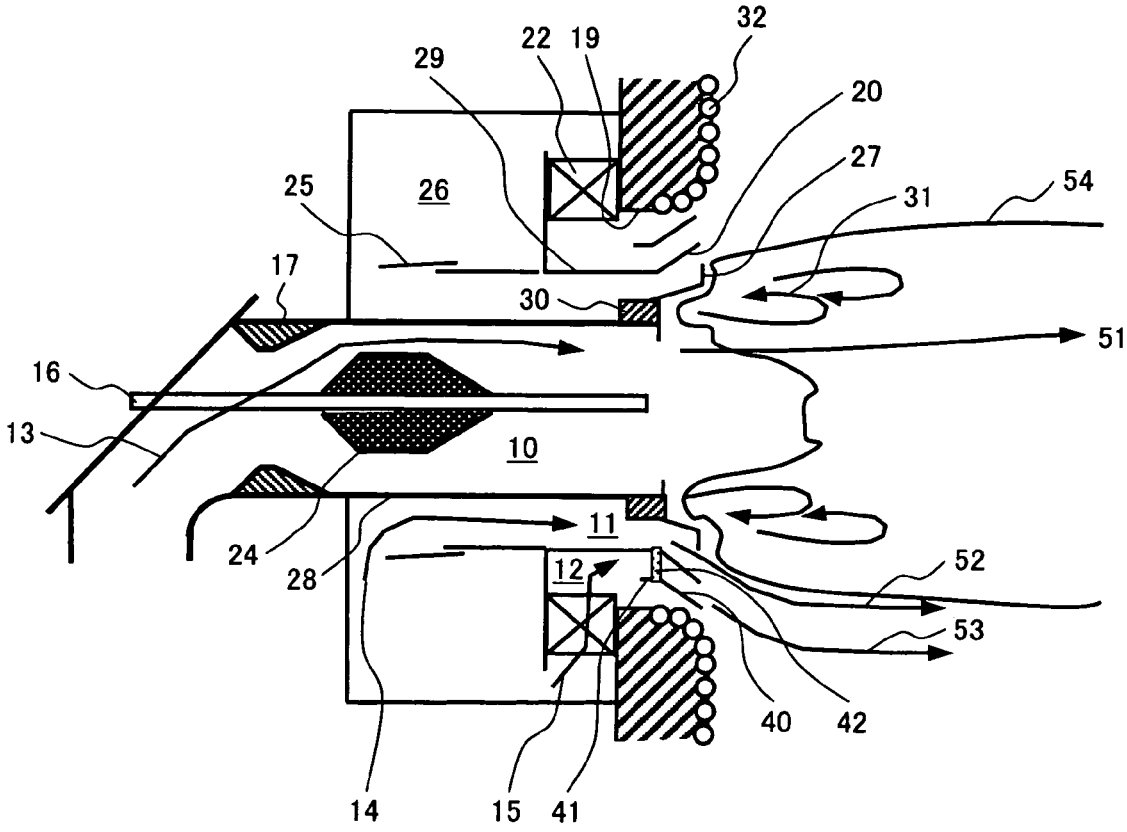
FIG. 1 is a schematic cross-sectional view of a solid-fuel burner, viewed from the side, according to an embodiment of the present invention.

The reason why it is possible for the present invention to reduce thermal damage to the inductive member will be further explained by making comparisons with the case in which only one inductive member is provided.

When an inductive member is provided only in the air nozzle's inner circumferential end portion, to separate, near the burner, a fuel jet flow from a flow of air injected from the air nozzle, it is necessary to increase an inductive member's projected area in the burner's axial direction so that air injected from the air nozzle can be directed in the direction of the outer circumference. Generally, it is desirable that the inductive member's projected area in the burner's axial direction be at least 90% of the cross-sectional area (cross-sectional area vertical to the burner's axial direction) of the flow path in a portion (throat section) where the air nozzle's outer circumferential diameter is minimized. In this case, since the inductive member's projected area is large, the amount of radiation heat received from flame in a furnace becomes large, thereby causing the temperature of the inductive member to become high. As a result, thermal damage tends to occur.

Specifically, when combustion capacity per burner is to be increased, the amount of air supplied by one burner increases, which further increases the cross-sectional area of the air nozzle's flow path. Therefore, the inductive member's projected area also increases, and the amount of radiation heat received from the flame further increases. As a result, cooling performance of the inductive member material by thermal conduction relatively decreases, which increases the temperature of the end portion of the inductive member, easily causing thermal damage such as thermal deformation, or corrosion in the high-temperature location. Specifically, in the case of single-stage combustion in which the entirely all of the air required for burning solid fuels is supplied from a burner, the amount of air supplied by one burner increases when compared with two-stage combustion in which air for combustion is supplied in two ways: burner air port setting downstream in the furnace. Therefore, in the case of single-stage combustion, the inductive member's projected area further increases, easily causing thermal damage.

On the contrary, as shown in the present invention, when an expanding pipe section that functions as an inductive member is provided at the inner circumferential end portion of the outermost circumferential air nozzle, and at least one inductive member is provided inside the nozzle, by dividing the inductive member into two or more portions, it is possible for the air injected from the air nozzle to flow on both sides of the outer circumferential inductive member. Because the injected air which flows on both sides of the inductive member is at a lower temperature than that in the furnace, the inductive member is cooled on both sides as the result of heat transfer by convection. Furthermore, the projected area of the innermost circumferential inductive member, which is an expanding pipe section provided at the end of the inner circumferential wall, can be further reduced when compared with the case in which a single inductive member is provided. Consequently, the amount of radiation heat received from the flame is reduced, the amount of heat radiation due to convective heat transfer caused by thermal conduction inside the inductive member and the flow of air on the outer circumference relatively increases, and the temperature of the partition wall's end portion decreases. As a result, it is possible to prevent thermal damage such as thermal deformation and corrosion in high-temperature location from occurring.

The present invention can be equally applied in the case where only one air nozzle is provided and the case where a plurality of air nozzles are provided. In the case where a plurality of air nozzles are provided, the present invention does not intend to exclude the case where in addition to the outermost circumferential air nozzle, a plurality of inductive members are provided in the inner circumferential air nozzle, that is, an air nozzle close to the fuel nozzle.

As described later, a burner according to an embodiment of the present invention comprises a secondary air nozzle located outside the fuel nozzle; a tertiary air nozzle located outside the secondary air nozzle; an expanding pipe section provided at the end portion of the inner circumferential wall of the tertiary air nozzle that also functions as the outer circumferential wall of the secondary air nozzle; and an inductive member provided at the outlet in the tertiary air nozzle so that tertiary air can be directed in the direction of the outer circumference; and it was verified that this configuration makes it possible to reduce thermal damage to the inductive member.

It is also possible to provide a plurality of inductive members inside the air nozzle. In that case, it is desirable that a plurality of inductive members be concentrically provided around the burner's central axis. Furthermore, by providing an inductive member only at the nozzle outlet, and not providing the inductive member in the upstream portion of the nozzle, it is possible to reduce pressure loss.

It is desirable that an inductive member provided at the outlet in the air nozzle be circular-cone shaped so that it flares out toward the end. Furthermore, it is desirable that a guide member which is parallel to the throat section of the outer circumferential wall of the outermost circumferential air nozzle be connected to the upstream portion of the flared and circular-cone shaped inductive member. Because the guide member, which is parallel to the throat section of the outer circumferential wall of the outermost circumferential air nozzle, rectifies the flow of air, thereby reducing pressure loss.

When the outermost circumferential air nozzle comprises, in the sequential order from upstream side of the air flow, a flow path where air flows radially toward the burner's central axis, a flow path where air flows in the direction parallel to the burner's central axis, and an outlet section where air is directed by an inductive member in the direction of the outer circumference and injected; in a portion where the direction of air flow changes from the radial direction to the axial direction, a pressure decreases near the flow path's outer circumferential wall (throat section), and a stagnation region tends to appear where retarded air flow and reverse flow are generated. By creating a guide member on the upstream portion of the inductive member so that the guide member is parallel to the throat section of the outer circumferential wall of the outermost circumferential air nozzle, flow of air is rectified. Consequently, pressure loss near the outer circumferential wall (throat section) of the flow path is reduced, thereby making it possible to reduce the stagnation region. At that point, it is desirable that the length of the portion parallel to the throat section of the outer circumferential wall of the outermost circumferential air nozzle be half the length or less of the throat section. By doing so, the portion where the direction of air flow changes from the radial direction to the axial direction does not interfere with the guide section provided on the upstream portion of the inductive member, thereby making it possible to reduce pressure loss. As a result, it is also possible to reduce air blower power.

In the present invention, the projected area per inductive member in the burner's axial direction decreases, however, a plurality of inductive members are provided and the entire projected area does not change. Furthermore, in the present invention, in the same manner as the conventional burner, it is desirable that the projected area of the inductive member in the burner's axial direction be 90% or more of the cross-sectional area of the flow path in the throat section of the outer circumferential wall of the outermost circumferential air nozzle.

In the present invention, it is desirable that the outermost circumferential air nozzle comprise, in the sequential order from the upstream side of the air flow, a flow path where air flows radially toward the burner's central axis, a flow path where air flows in the direction parallel to the burner's central axis, and an injection section where air is directed in the direction of the outer circumference by an inductive member and an expanding pipe section having an induction function and injected; and a swirl generator be provided in the flow path where air flows radially toward the burner's central axis. When compared with the case in which a swirl generator is provided in a portion where air flows in the axial direction, by providing a swirl generator in the flow path where air flows radially, it is possible to generate the same swirl intensity at low pressure loss.

It is desirable that the inductive member be fixed by a plurality of supporting plates or rods which are fixed onto the air nozzle's inner circumferential wall. In an ordinary boiler, due to different thermal expansion, the distance between the water wall which functions as an outer circumferential wall of the outermost circumferential air nozzle and the burner's central axis changes according to the operating load. By fixing the inductive member on the inner circumference, it is possible to keep the area of the inner circumference-side flow path constant. The influence on the combustion performance is greater in the inner circumference-side flow path near the fuel jet flow; therefore, even if the distance between the water wall and the burner's central axis changes, it is possible to reduce variation of the combustion performance. Furthermore, the temperature of the inner circumference-side flow path, where air and fuel jet flow, is lower than that of the opening of the water wall made by heat insulating material. By using a supporting plate or rod to connect the inductive member to the air nozzle's inner circumference, it is possible to lower the temperature of the inductive member because of the thermal conduction of the supporting plate.

Furthermore, it is desirable that a flame stabilizer which blocks the fuel jet flow injected from the fuel nozzle and the flow of air injected from the air nozzle, be provided at the end portion of the partition wall that separates the end portion of the fuel nozzle outlet. A negative pressure section is created downstream of the flame stabilizer due to the surrounding air flow. A circulating flow that flows from the downstream to the upstream and introduce high-temperature combustion gas, promotes ignition of fuel particle. Therefore, the formation of a flame is accelerated, and hot and deoxidization flame zone expands. In this high-temperature deoxidization flame, deoxidization species are generated, thereby reducing the formation of NOx by a reaction that reduces NOx to nitrogen.

It is desirable that the fuel nozzle comprise an obstacle which includes a region which decreases the cross-sectional area of the nozzle's flow path and a region which subsequently increases the cross-sectional area of the flow path. This obstacle induces velocity components oriented in the direction of the outer circumference in fuel particles. Because the inertial force of fuel particles is greater than that of carrier gas, fuel particles are biased toward the inner circumference of the outer partition wall of the fuel nozzle and reach the nozzle outlet. Consequently, fuel particles are condensed near the outer partition wall of the fuel nozzle, which improves ignition property at the fuel nozzle outlet, thereby facilitating flame stabilization.

The burner according to the present invention is specifically effective for single-stage combustion in which the entirely all of the air required for burning solid fuels is supplied through a burner. This is because the amount of air supplied by one burner is greater than two-stage combustion in which air for combustion is supplied in two ways: burners air ports setting downstreams. Therefore, the projected area necessary for the inductive member is greater.

EMBODIMENT 1

Figure 2:
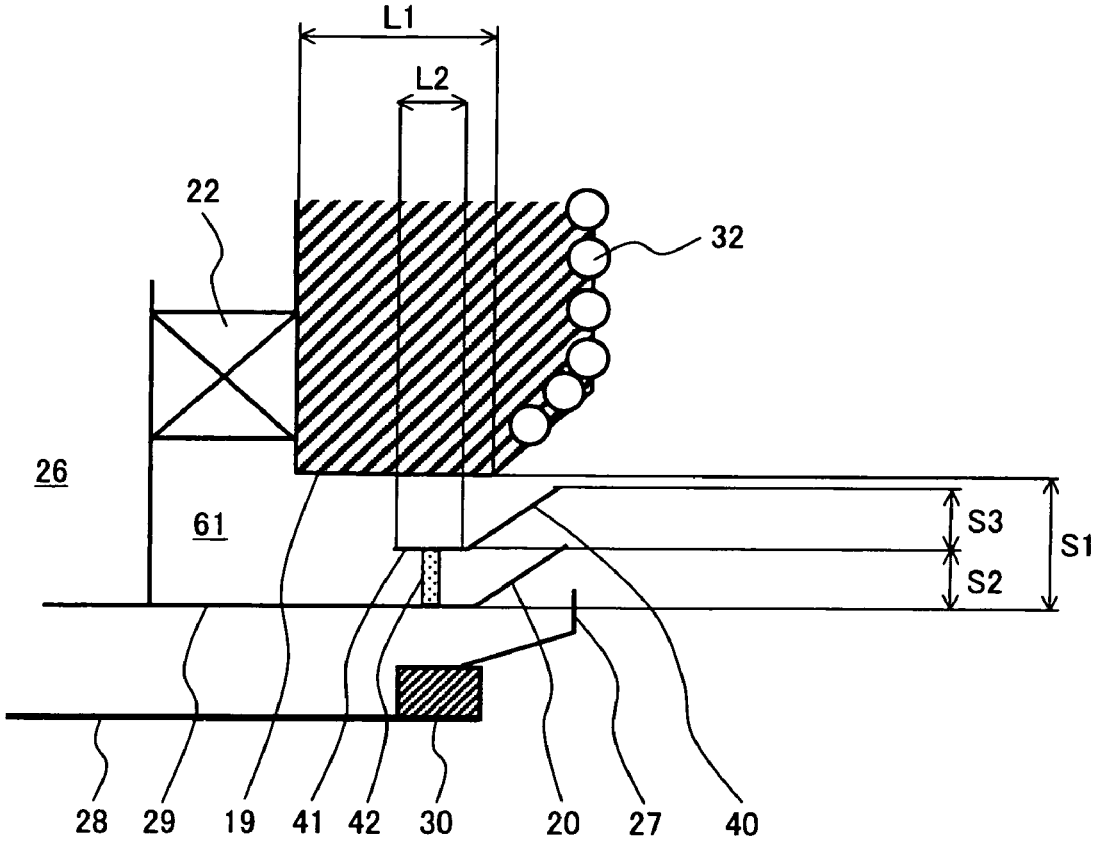
FIG. 2 is an enlarged, schematic cross-sectional view of the tertiary air nozzle of the burner shown in FIG. 1.
Figure 3:
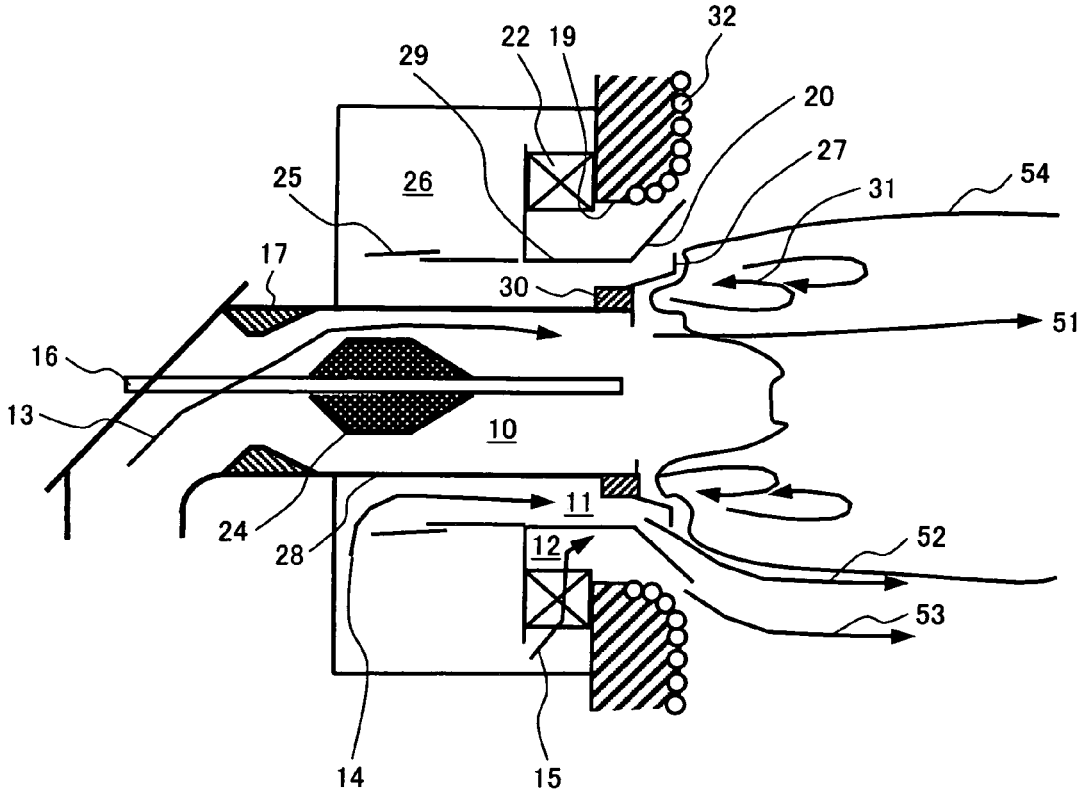
FIG. 3 (PRIOR ART)
FIG. 3 is a schematic cross-sectional view of a solid-fuel burner, viewed from the side, relating to a prior art indicating for comparison with the first embodiment of the present invention.
Figure 4:
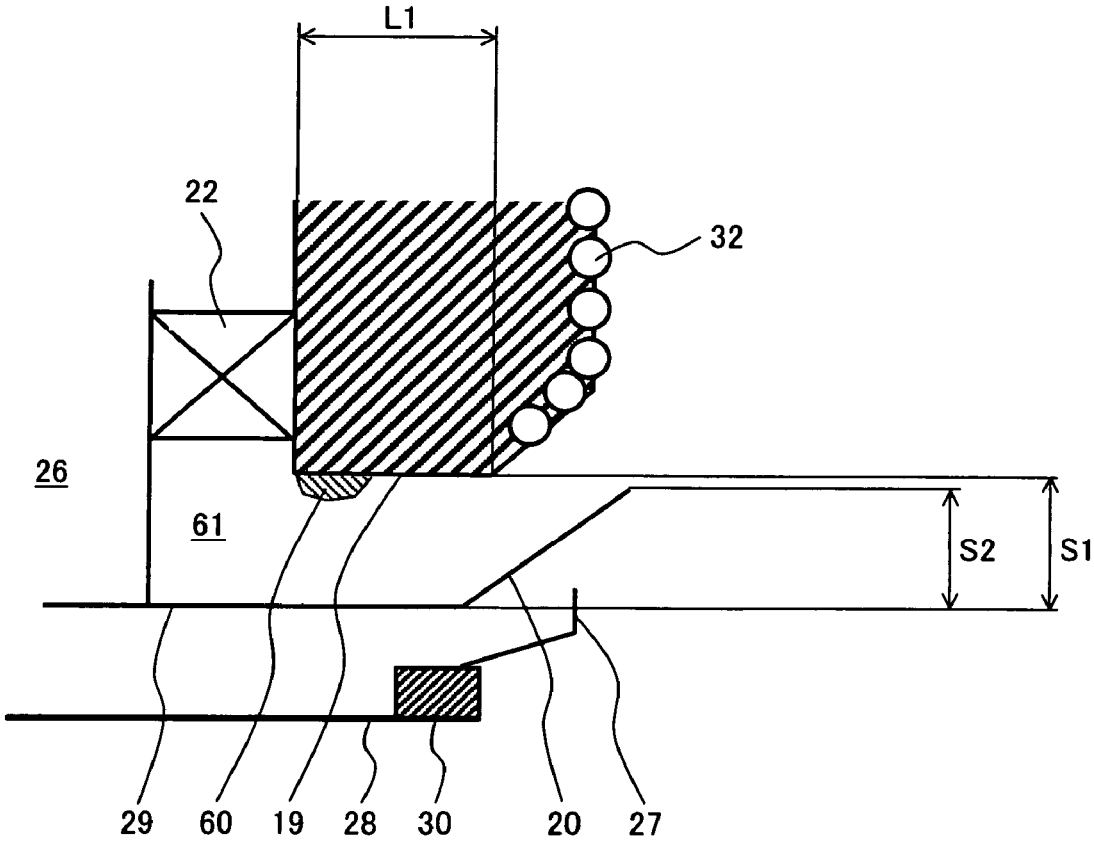
FIG. 4 (PRIOR ART)
FIG. 4 is an enlarged, schematic cross-sectional view of the tertiary air nozzle of the burner shown in FIG. 3.

A first embodiment of the present invention will be explained with reference to FIG. 1 through FIG. 5. FIG. 1 is a schematic cross-sectional view of a solid-fuel burner viewed from the side, according to the first embodiment of the present invention. FIG. 3 is also a schematic cross-sectional view of the solid-fuel burner viewed from the side, relating to a prior art indicating for comparison with the first embodiment of the present invention. FIG. 2 is an enlarged schematic cross-sectional view of the outlet of the outermost circumferential air nozzle of the burner shown in FIG. 1, and FIG. 4 is an enlarged schematic cross-sectional view of the outlet of the outermost circumferential air nozzle of the burner shown in FIG. 3.

In FIG. 1, a fuel nozzle 10 is connected, in the upstream portion, to a fuel pipe, not shown in the figures, and injects solid fuels along with carrier primary air. A secondary air nozzle 11 for injecting secondary air is provided on the outer circumference of the fuel nozzle 10, and a tertiary air nozzle 12 for injecting tertiary air is provided on the outer circumference of the secondary air nozzle 11. When looking at the fuel nozzle 10, secondary air nozzle 11, and the tertiary air nozzle 12 from the front of the burner outlet, an annular secondary air nozzle 11 is located outside the fuel nozzle 10 so that the secondary air nozzle 11 is concentric with the fuel nozzle 10, and an annular tertiary air nozzle 12 is located outside the secondary air nozzle 11 so that the tertiary air nozzle 12 is concentric with the secondary air nozzle 11. The tertiary air nozzle 12 constitutes an outermost circumferential air nozzle. The flow allocation ratio of primary air, secondary air, and tertiary air is, for example, 1 to 2: 1: 3 to 7. The arrow 13 indicates a mixed flow of solid fuels and primary air, and arrows 14 and 15 indicate the flow of secondary air and tertiary air, respectively. An oil gun 16 that penetrates the fuel nozzle 10 is provided inside the fuel nozzle 10, and is used to assist burning at the start of burner operation or at the time of low-load combustion. A venturi 17 is provided inside the fuel nozzle 10 to prevent backfire of solid fuels. At the end portion of the partition wall 28 that separates the fuel nozzle 10 from the secondary air nozzle 11, a flame stabilizer 30 is provided to enlarge circulating flow 31 between primary air and secondary air. This flame stabilizer 30 comprises an obstacle that narrows the flow path of the secondary air nozzle 11 and obstacles that narrows the opening of the end portion of the fuel nozzle 10. The outer circumferential wall of the tertiary air nozzle 12 is a burner throat 19 that is constituted by the furnace wall. The secondary air nozzle 11 is separated from the tertiary air nozzle 12 by the partition wall 29, and an inductive member 20, which is a guide sleeve, that expands radially to the burner's central axis is provided at the end portion of the partition wall 29. This inductive member 20 enables tertiary air to be injected outwardly so that the air flow is away from the burner's central axis. Furthermore, an inductive member 40 and a cylindrical guide member 41 connected thereto are provided inside the tertiary air nozzle 12. The inductive member 40 and the guide member 41 are fixed onto the supporting rod 42, and the other end of the supporting rod 42 is fixed onto the partition wall 29. Herein, a plurality of supporting rods 42 are provided. FIG. 3 is a comparative example of the prior art for comparing with the solid-fuel burner shown in FIG. 1, and what is different from FIG. 1 is that an inductive member 40 and a guide member 41 are not provided. Furthermore, in FIG. 3, the end portion of the inductive member 20 extends further above the burner throat of the outer circumferential wall of the tertiary air nozzle 12. A swirl generator 22 for providing swirl velocity compornent to tertiary air 15 is located in the tertiary air nozzle 12. This swirl generator 22 commonly uses an air swirl vane called a resistor vane. Secondary air 14 and tertiary air 15 are supplied from a wind box 26, and the amount of secondary air 14 is adjusted by a damper 25. The amount of transfer of the damper 25 will determine the amount of tertiary air 15. Water pipes 32 is located on the inner wall of the furnace. At the end of the inner circumferential wall of the secondary air nozzle 11, a guide plate 27 is provided which directs secondary air 14 in the direction of the outer circumference. Furthermore, inside the fuel nozzle 10, an obstacle 24 is provided which narrows the flow path so as to temporarily move the fuel jet flow toward the outer circumference, and then expand the flow path. The arrow 51 indicates the direction of the fuel jet flow, which is a mixed fluid of solid fuels injected from the fuel nozzle 10 and primary air. The arrow 52 indicates the direction of flow of secondary air injected from the secondary air nozzle 11, and the arrow 53 indicates the direction of flow of tertiary air injected from the tertiary air nozzle 12. Number 54 indicates the outer circumferential region of the flame created by the jet flow coming from the fuel nozzle 10.

During the combustion by a burner shown in FIG. 1, by means of a flame stabilizer 30 located at the end portion of the partition wall 28 that separates the fuel nozzle 10 from the secondary air nozzle 11, the pressure in the downstream region decreases, and a circulating flow 31 from downstream to upstream is created. The circulating flow 31 traps high-temperature gas; therefore, ignition of fuel particles is promoted, thereby improving the flame stability. In this embodiment, because an obstacle 24 is provided inside the fuel nozzle 10, solid fuel particles tend to be directed toward the partition wall 28 side of the outer circumference of the fuel nozzle 10. Consequently, fuel concentration near the flame stabilizer 30 increases, thereby accelerating ignition.

When a flame is created near the outlet of the fuel nozzle 10 and consumption of oxygen is promoted, a deoxidized flame region where oxygen concentration is low expands in the flame. In the deoxidized flame, nitrogen content included in solid fuels is discharged as a deoxidized materials, such as ammonia or cyanogen, which functions as a deoxidized matter that reduces NOx to nitrogen. As a consequence, it is possible to reduce the amount of generated NOx. Furthermore, because ignition is accelerated, combustion reaction of solid fuels is promoted, and unburned substance in the fuel ash decreases. By providing a guide plate 27 and inductive members 20 and 40 in the outlet of the secondary air nozzle 11 and the tertiary air nozzle 12, respectively, to direct air flow in the direction of the outer circumference, the flow of fuel mixed fluid, flow of secondary air, and flow of tertiary air are away from one another, as indicated by the arrows 51, 52 and 53. Consequently, the mixing of solid fuels, secondary air, and tertiary air near the burner is delayed, which causes the deoxidized flame region to expand.

A solid-fuel burner according to the present invention, shown in FIG. 1, comprises inductive members 20 and 40 which are located at the outlet of the tertiary air nozzle 12 and direct flow of tertiary air 15 in the direction of the outer circumference. The inductive members 20 and 40 are shaped like a circular cone which flares out toward the nozzle's outlet, and when viewed from the front of the burner, an inductive member 20 is located inside and an inductive member 40 are concentrically located outside. In this embodiment, two inductive members are provided, but more than two inductive members can be provided. By providing a plurality of inductive members, tertiary air 15 flows on both sides of the outer circumference-side inductive member 40. Since tertiary air 15, the temperature of which is lower than that in the furnace, flows on both sides of the inductive member 40, the inductive member 40 is cooled due to the convective heat transfer on both sides. Furthermore, the inductive member 20 located on the innermost circumference of the tertiary air nozzle 12 has a smaller projected area (S2) in the burner's axial direction when compared to the inductive member 20 shown in the comparative example in FIG. 4. Therefore, the amount of radiation heat received from the flame is reduced, and the amount of heat radiation caused by convective heat transfer due to thermal conduction in the inductive member and air relatively increases. As a result, the temperature of the end portion of the inductive member 20 decreases, thereby preventing thermal damage such as thermal deformation or corrosion in a high-temperature.

In the present invention, although the area per inductive member 20 and 40 is smaller than the area shown in FIG. 3 and FIG. 4, a plurality of inductive members are provided, and the entire projected area does not change. If the projected area of the inductive member 20 and 40 in the burner's axial direction, represented by the sum of S2 plus S3 as shown in FIG. 2, is generally 90% or more of the cross-sectional area (cross-sectional area (S1) vertical to the solid-fuel burner's axial direction) of the flow path in a throat section at which the tertiary air nozzle's diameter is minimized, it is possible for the inductive members 20 and 40 to direct the entirely all of the air. Furthermore, in this embodiment, a guide member 41 is provided on the upstream side of the inductive member 40 so that the guide member 41 is parallel to the burner throat 19. This configuration enables tertiary air to be rectified, thereby reducing pressure loss.

The flow path of the outermost circumferential air nozzle comprises a flow path where air flows radially from upstream side to the burner's central axis, a flow path where air flows in the direction parallel to the burner's central axis, and an injection section where air is injected in the direction of the outer circumference by means of the inductive members 20 and 40. In this case, in a portion where air flow changes from the radial direction to the axial direction, the pressure decreases near the throat section which is the outer circumferential wall of the flow path, and the flow speed in the air nozzle decreases, and recirculation flow (stagnation region) 60 tends to appear as shown in FIG. 4. By providing a guide member 41 in FIG. 2, which is a portion parallel to the throat section's inner circumference-side partition wall, on the upstream portion of the inductive member 40, air flow is rectified, and pressure reduction near the throat section is inhibited, thereby making it possible to eliminate or reduce the stagnation region. Moreover, by reducing the length (L2) of the guide member 41 to half of the length (L1) of the throat section or less, the portion 61 where the direction of air flow changes from the radial direction to the axial direction in the air nozzle does not interfere with the upstream-side end portion of the guide member 41. As a result, pressure loss can be reduced and air distribution power can also be reduced.

Figure 5:
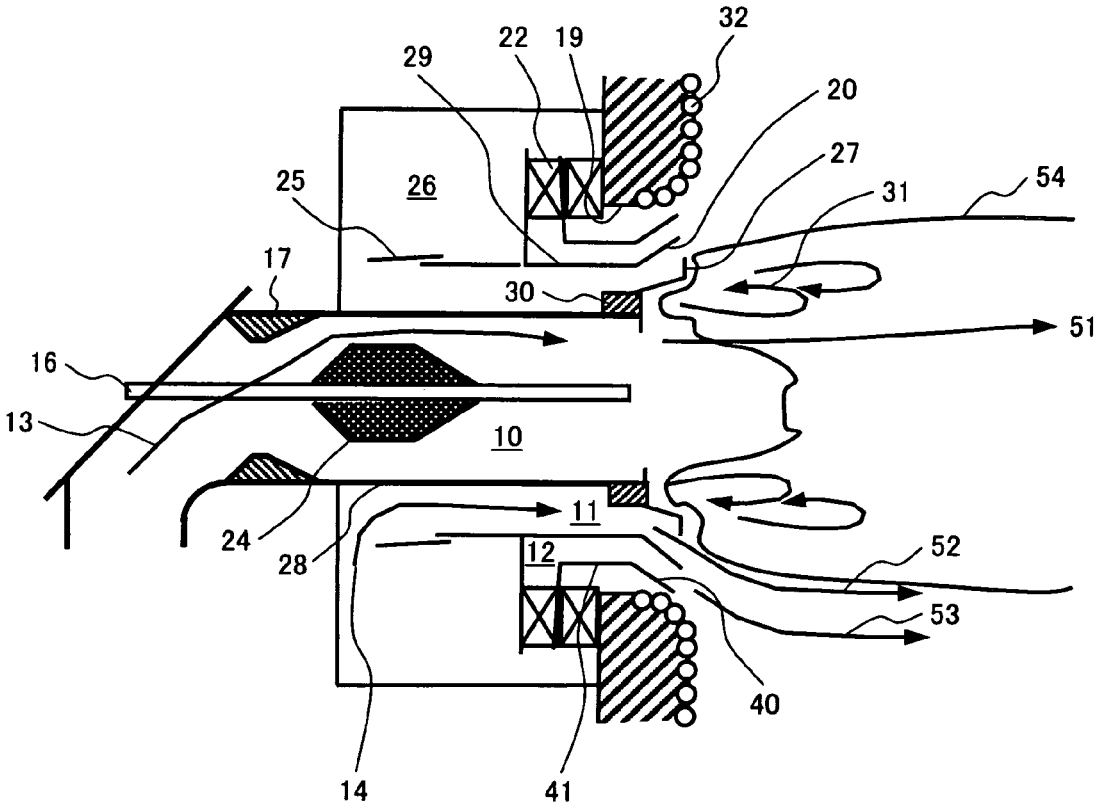
FIG. 5 (PRIOR ART)
FIG. 5 is a schematic cross-sectional view of a solid-fuel burner, viewed from the side, relating to another prior art indicating for comparison with the first embodiment of the present invention.

As shown in a comparative example of the prior art in FIG. 5, there is an idea that divides the tertiary air nozzle 12 into a plurality of portions. However, in this case, inside the plurality of tertiary air nozzles, a stagnation region may appear near the outer circumferential wall of the portion where tertiary air flow changes from the radial direction to the axial direction. Therefore, this is relatively not so preferable.

The tertiary air nozzle 12 of the burner, shown in FIG. 1, includes a swirl generator 22 in a flow path which is radially created in the direction of the burner's central axis. By changing the swirl velocity components of tertiary air 15 by means of the swirl generator 22, it is possible to change the position at which fuel jet flow indicated by the arrow 51 and tertiary air flow indicated by the arrow 53 are mixed. Generally, increasing swirl velocity components will delay the mixing.

Furthermore, the inductive member 40 and the guide member 41 are fixed by a plurality of supporting plates or rods 42 located on the tertiary air nozzle's inner circumference-side partition wall 29 in the circumferential direction. In an ordinary boiler, due to different thermal expansion, the distance between the burner throat 19 of the furnace wall, which constitutes an outer circumference of the outermost circumferential air nozzle, and the burner's central axis changes according to the operating load. By fixing the inductive member 40 onto the inner circumferential wall of the tertiary air flow path, it is possible to keep the area of the inner circumference-side flow path constant. Furthermore, the influence on the combustion performance is greater in the inner circumference-side flow path near the fuel jet flow; therefore, even if the distance between the water wall and the burner's central axis changes, it is possible to reduce variation of the combustion performance. Furthermore, the temperature of the inner circumference-side flow path, where air and fuel jet flow, is lower than that of the furnace wall comprised of heat insulating material and an aqueduct. By connecting the inductive member 40 to the inner circumference of the air flow path, it is possible to decrease the temperature of the inductive member 40 due to the thermal conduction of the supporting plates or rods.

A solid-fuel burner according to this embodiment is specifically effective for the single-stage combustion in which the entirely all of the air required for burning solid fuels is supplied through a burner. This is because the amount of air supplied by one burner is greater than two-stage combustion in which air for combustion is supplied in two ways: burning and after burning. Therefore, the area of the inductive member increases.

EMBODIMENT 2

Figure 6:
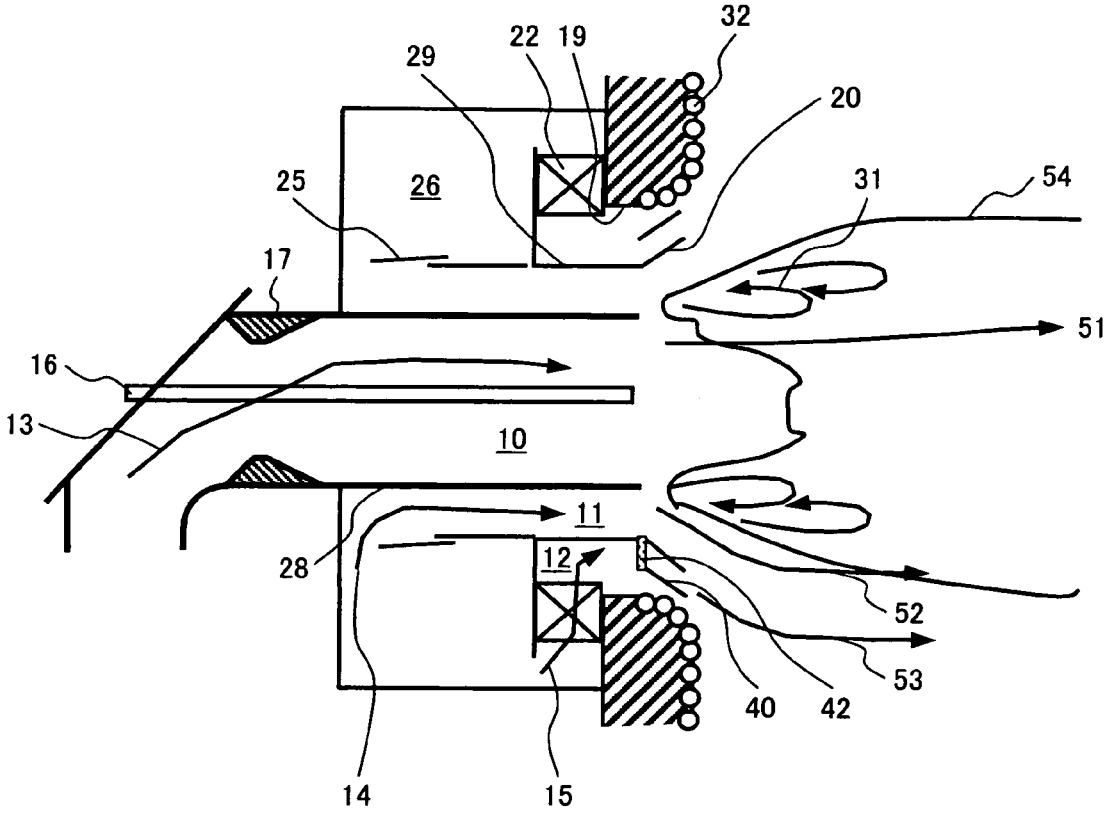
FIG. 6 is a schematic cross-sectional view of a solid-fuel burner, viewed from the side, according to further embodiment of the present invention.

FIG. 6 is a schematic cross-sectional view of a solid-fuel burner, viewed from the side, which is a second embodiment according to the present invention. In FIG. 6, a guide member 41 is not provided on the upstream portion of the inductive member 40. In this configuration, as is in the same manner as the embodiment 1, it is possible to reduce thermal deformation and thermal damage of the inductive members 20 and 40. In FIG. 6, both an obstacle 24 in the fuel nozzle 10 and a flame stabilizer 30 at the fuel nozzle outlet are omitted. Although in this case, combustion performance decreases when compared with the case where an obstacle 24 and a flame stabilizer 30 are provided; however, there are no practical problems when solid fuels that have high ignition performance are used.

An expanding pipe section is provided at the end portion of the inner circumferential wall of the outermost circumferential air nozzle, and an inductive member is provided inside the nozzle to direct the flow of air in the direction of the outer circumference. This configuration substantially gives the same effect as the case wherein a plurality of inductive members are provided in one air nozzle. In this case, the projected area per inductive member in the burner's axial direction can be smaller than the case wherein only one inductive member is provided. As a consequence, it is possible to prevent the occurrence of thermal damage.

In the burner according to the present invention wherein the mixing of solid fuels, such as coal particles, with tertiary air is retarded by means of an inductive member, it is possible to reduce thermal damage or thermal deformation of the inductive member. This verifies that the practical effects are great.

What is claimed is:

1. A solid-fuel burner, comprising a fuel nozzle for injecting a mixed fluid with a mixture of solid fuel and air as a carrier gas thereof, a plurality of air nozzles provided on the outside of the fuel nozzle for surrounding the fuel nozzle; an end portion of an inner circumferential wall of the air nozzle being located at least at the outermost circumference of the air nozzle and provided with an outwardly expanding portion, an inductive member provided at an outlet of the air nozzle and located at least on the outermost circumference so as to direct flow of air in the direction of outer circumference, and a guide member provided in an upstream portion of the inductive member parallel to a throat section of outer circumferential wall of the air nozzle, wherein the inductive member is operatively connected to the guide member, and the length of the guide member is no greater than half of the length of the throat section of the outer circumferential wall of the air nozzle.

2. A solid-fuel burner according to claim 1, wherein an outermost circumferential one of the air nozzles further comprises, in sequential order from an upstream side of the air flow, a first flow path where air flows radially toward the burner's central axis, a second flow oath where air flows in the direction parallel to the burner's central axis, and an injection portion where air is directed and injected in the direction of the outer circumference of the air nozzle by the inductive member and the outwardly expanded portion of the air nozzle.

* * * * *